US006605768B2

(12) United States Patent
Date et al.

(10) Patent No.: US 6,605,768 B2
(45) Date of Patent: Aug. 12, 2003

(54) MUSIC-SIGNAL COMPRESSING/ DECOMPRESSING APPARATUS

(75) Inventors: Toshihiko Date, Nara (JP); Ryousuke Kobayashi, Tokyo (JP); Michiko Ogawa, Osaka (JP); Tomomi Hirata, Neyagawa (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 89 days.

(21) Appl. No.: 09/998,320

(22) Filed: Dec. 3, 2001

(65) Prior Publication Data

US 2002/0078817 A1 Jun. 27, 2002

(30) Foreign Application Priority Data

Dec. 6, 2000 (JP) ..... 2000-371074

(51) Int. Cl.[7] ..... G10H 7/00
(52) U.S. Cl. ..... 84/604
(58) Field of Search ..... 84/600–604, 609–614, 84/626, 662

(56) References Cited

U.S. PATENT DOCUMENTS 5,464,946 A * 11/1995 Lewis ..... 84/609
5,848,164 A * 12/1998 Levine ..... 381/61
5,886,276 A * 3/1999 Levine et al. ..... 84/603

FOREIGN PATENT DOCUMENTS

| | | |
|---|---|---|
| JP | 5-265499 A | 10/1993 |
| JP | 10-240299 A | 9/1998 |
| JP | 2001-34299 A | 2/2001 |

* cited by examiner

*Primary Examiner*—Jeffrey Donels
(74) *Attorney, Agent, or Firm*—Smith Patent Office

(57) ABSTRACT

Upon receipt of a music signal from a music-signal input section, a sound-source separating section in a preprocessing section separates the music signal into a plurality of signals in units of the type of audio source. A physical-property converting section changes a physical property of each of the signals on the basis of control information received from a control-information input section. A signal-synthesizing section synthesizes a plurality of output signals outputted from the physical-property converting section, and supplies the resultant signal to a data-compressing section. For example, in compressed data, a high data rate is allocated to a vocal, whereas low data rates are allocated to other parts. As a result, quality improvement can be implemented in auditory perceptibility of a musically important part.

41 Claims, 10 Drawing Sheets

FIG. 3

| Part No. | Part Name | Band | Dynamic Range | Couping | |
|---|---|---|---|---|---|
| 0 | Vocal | No limitation | No limitation | None | |
| 1 | Others | <5kHz | <40dB | >8kHz | |
| | | | | | |
| | | | | | |
| | | | | | |
| | | | | | |
| | | | | | |

FIG. 5

| Part No. | Part Name | Trigger Level | Band | Dynamic Range | Couping |
|---|---|---|---|---|---|
| 0 | Piano | −25dB | No limitation | <40dB | None |
| 1 | Bass | −10dB | <150Hz | <20dB | >0Hz |
| 2 | Drum | −15dB | <5kHz | <40dB | >8kHz |
| 3 | Others | −20dB | <5kHz | <30dB | >8kHz |
| | | | | | |
| | | | | | |
| | | | | | |

MUSIC-SIGNAL COMPRESSING/ DECOMPRESSING APPARATUS

BACKGROUND OF THE INVENTION

1. Field of the Invention

The present invention relates to a music-signal compressing apparatus that records a music signal by controlling a compression method according to a part thereof, a music-signal decompressing apparatus that decompresses the signal, and a music-signal compressing/decompressing apparatus that records or reproduces the music signal by controlling compression and decompression methods.

2. Discussion of the Related Art

Generally, a music signal is composed of a plurality of parts representing, for example, melody sound and rhythm sound, or vocal sound and accompany sound, which are different in musical semantics. In listening to music, a human being is capable of separately recognize each of the plurality of parts through psychoacoustic processing. In addition, in most cases, human-being auditory senses for these individual parts are not uniform, and they are greatly different depending on musical importance. In more specific, it can be considered that, in many cases, an ordinary human listener enjoying music concentrates his/her senses on, for example, melody sound and vocal sound. This is equivalent to a case where an auditory masking phenomenon occurs between multiple audio sources.

In conventional compression methods, compression processing is performed using the same algorithm even when, for example, a music signal to be compressed is composed of a plurality of parts as those described above, and a music signal does not have, for example, musical semantics or a musical structure as in the case of a single audio source.

However, in the conventional compression methods as described above, the compression-encoding data rate is allocated without distinction either to a signal component of a part having high musical importance or to a signal component of a part not having high musical importance. As such, when the compression rate is increased, quality of reproduced audio is degraded at the same level both in the signal component having high musical importance and in the signal component not having high musical importance without distinction.

SUMMARY OF THE INVENTION

An object of the present invention is to realize a music-signal compressing apparatus, a music-signal decompressing apparatus, and a music-signal compressing/decompressing apparatus in which the data rate to be allocated to a signal component of a part having high musical importance in compressed data can be increased to be relatively high in comparison to the case of compressed data in conventional methods.

A music-signal compressing/decompressing apparatus of the present invention includes a music-signal input section, a preprocessing section, a data-compressing section, a data-storage section, and a music-signal output section. The music-signal input section inputs a music signal. The preprocessing section preprocesses an output signal of the music-signal input section at a stage preceding compression processing. The data-compressing section performs compression processing for an output signal of the preprocessing section. The data-storage section stores data compressed by the data-compressing section. The data-decompressing section performs decompression processing for compressed data read out of the data-storage section. The music-signal output section outputs an output data of the data-decompressing section as a music signal. The preprocessing section includes an audio-source separating section for performing separation processing to separate the output signal of the music-signal input section into signals in units of the type of audio source; a physical-property converting section for performing physical-property converting processing to change a physical property of each of the signals separated by the audio-source separating section; a signal-synthesizing section for synthesizing a plurality of signals that have been outputted from the physical-property converting section; a control-information input section for inputting control information regarding the contents of the audio-source separation processing performed by the audio-source separating section and the contents of the physical-property converting processing; and a preprocess control section for performing control of the audio-source separating section and the physical-property converting section according to control information that has been outputted from the control-information input section.

The music-signal compressing/decompressing apparatus may be configured in which the preprocessing section further comprises audio-source analyzing section which performs analysis of the physical property of at least one of the signals separated by the audio-source separating section; the physical-property converting section which inputs an output signal of the audio-source analyzing section, and performs the physical-property converting processing according to the output signal for changing the physical property of at least one of the signals separated by the audio-source separating section; and the preprocess control section which performs control of the audio-source separating section and the physical-property converting section according to analysis-result data that has been outputted from the audio-source analyzing section and the control information that has been outputted from the control-information input section.

In consideration regarding human psychoacoustic processing, signal processing is performed for a signal component that has low musical importance to reduce a part of an energy component thereof, and thereafter, compression processing is performed.

BRIEF DESCRIPTION OF THE DRAWINGS

FIG. 3 is a schematic view showing an input screen of a control-information input section in the music-signal compressing/decompressing apparatus according to the first embodiment;

FIG. 5 is a schematic view showing an input screen of a control-information input section in the music-signal compressing/decompressing apparatus according to the second embodiment;

DETAILED DESCRIPTION OF THE PREFERRED EMBODIMENTS (First Embodiment)

Figure 1:
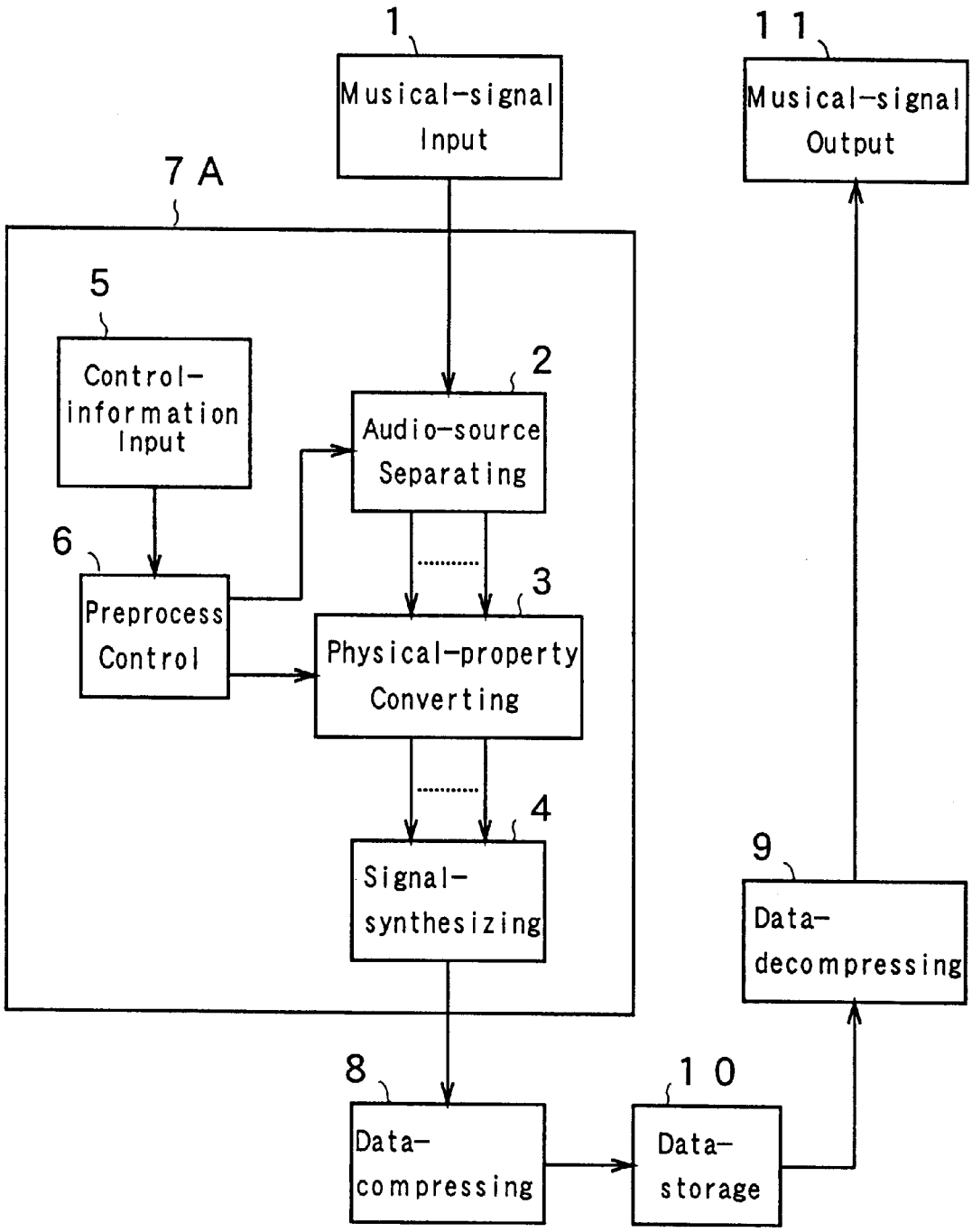
FIG. 1 is a configuration view of a music-signal compressing/decompressing apparatus according to a first embodiment of the present invention.

Hereinbelow, a music-signal compressing/decompressing apparatus according to a first embodiment of the present invention will be described with reference to drawings. FIG. 1 is a configuration view of a music-signal compressing/decompressing apparatus of the first embodiment. The music-signal compressing/decompressing apparatus is configured to include a music-signal input section 1, a preprocessing section 7A, a data-compressing section 8, a data-decompressing section 9, a data-storage section 10, and a music-signal output section 11. In the preprocessing section 7A, there are provided an audio-source separating section 2, a physical-property converting section 3, a signal-synthesizing section 4, a control-information input section 5, and a preprocess control section 6. The music-signal input section 1, the preprocessing section 7A, and the data-compressing section 8 have a function as a music-signal compression apparatus. In addition, the music-signal compression apparatus may be configured to additionally include the data-storage section 10.

The music-signal input section 1 is an interface through which a music signal is inputted, and the input music signal is supplied to the preprocessing section 7A. For the music signal received from the music-signal input section 1, the preprocessing section 7A performs preprocessing as preliminary-stage processing of compression processing. The data-compressing section 8 compresses an output signal of the preprocessing section 7A. The data-storage section 10 stores data compressed by the data-compressing section 8. The data-decompressing section 9 decompresses the compressed data that has been outputted from the data-storage section 10. The music-signal output section 11 outputs the music signal received from the data-decompressing section 9.

In the preprocessing section 7A, the audio-source separating section 2 inputs the music signal sent from the music-signal input section 1, and separates the music signal into a plurality of signals in units of the type of audio source. The physical-property converting section 3 changes physical property of each of the signals divided by the audio-source separating section 2. The signal-synthesizing section 4 synthesizes the plurality of output signals of the physical-property converting section 3 into a signal to be inputted. The control-information input section 5 inputs (sets) information regarding the contents of the audio-source separating processing performed by the audio-source separating section 2 and the contents of the physical-property converting processing performed by the physical-property converting section 3. The preprocess control section 6 controls operations of the audio-source separating section 2 and the physical-property converting section 3 according to control information that has been outputted from the control-information input section 5.

Figure 2:
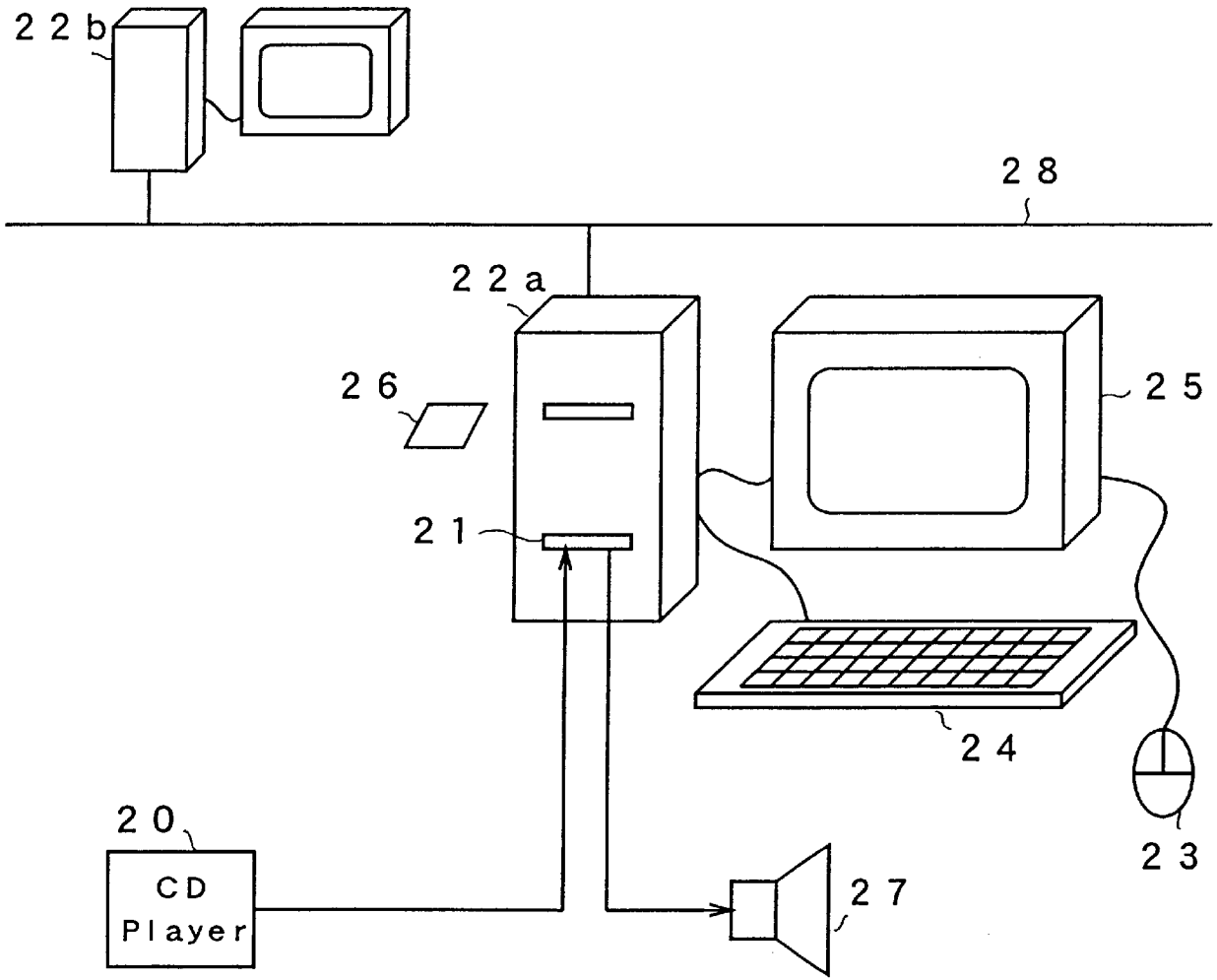
FIG. 2 is a schematic view showing a system apparatus that uses the music-signal compressing/decompressing apparatus.

FIG. 2 is a configuration view of a system apparatus that includes one a music-signal compression apparatus and a music-signal compressing/decompressing apparatus according to each embodiment of the present invention. A function of one of the music-signal compression apparatus or the music-signal compressing/decompressing apparatus is built in personal computers 22*a* and 22*b* shown in FIG. 2. A plurality of personal computers 22*a* and 22*b* are connected to a computer network 28. For example, a sound card 21 is provided in the personal computer 22*a,* and appliances such as a CD player 20 and a speaker 27 are connected to the sound card 21. In addition, the personal computer 22*a* includes a CPU, a memory, data buses, and the like in the inside; and the computer 22*a* is connected, for example, to a mouse 23, a keyboard 24, and a display 25. For example, compressed data created by the personal computer 22*a* is stored in a recording medium 26, and is transmitted to the different personal computer 22*b* via the computer network 28.

Hereinbelow, operation of the apparatus shown in FIG. 2 will be described. The personal computer 22*a* inputs specification data through an input device, for example, the mouse 23 or the keyboard 24; and various types of input data and output data are displayed on the display 25. Software installed in the personal computer 22*a* implements the execution of signal processing such as compression/decompression processing and preprocessing in one of the music-signal compression apparatus or the music-signal compressing/decompressing apparatus of the present invention.

The sound card 21 is built in the personal computer 22*a* and operates therein. The sound card 21 inputs a music signal from, for example, the CD player 20, and outputs a decompressed music signal to the speaker 27. Referring back to the compressed data, the compressed data is stored in the recording medium 26 when necessary.

To execute the signal processing such as compression/decompression processing and preprocessing, instead of the software, the system may use dedicated hardware fabricated of a semiconductor device including, for example, a built-in digital signal processor (DSP). In addition, although the compressed data is stored into the recording medium 26, the compressed data may also be transmitted via the computer network 28 to the other personal computer 22*b* that has the function of the music-signal compressing/decompressing apparatus.

Hereinbelow, operation of the music-signal compressing/decompressing apparatus shown in FIG. 1 will be described. The music data that has been inputted to the music-signal input section 1 is fed to the preprocessing section 7A before the data is inputted to the data-compressing section 8. The preprocessing section 7A performs a plurality of decompression operations to improve the audio quality of the post-compression/decompression output music data.

The audio-source separating section 2 separates the music signal inputted to the preprocessing section 7A into signals corresponding to the plurality of audio sources. Regarding the signal separation corresponding to the audio sources, conventional techniques have been disclosed. For example, U.S. Pat. No. 6,067,517 issued on May 23, 2000 for Bahl, et al discloses a technique for separating a human-voice representing vocal signal from other signals. Another example is U.S. Pat. No. 5,712,437 issued on Jan. 27, 1998 for Kageyama that discloses a technique for separating a plurality of signals and adding harmonic elements to parts of the signals. The audio source can be separated using these techniques.

In addition, a technique entitled as "acoustic-stream separation for speech with background music" has been proposed. According to the technique, when a signal representing a mixture of narration and music as a signal representing music-accompanying narration, processing methods corresponding to properties of two audio sources are appropriately used, and different audio source groups are thereby identified. In practice, proposals have been made for knowledge representation of sound using ontology, and a hierarchical multiagent architecture for separating an audio source according to knowledge representation.

In addition, for performing audio-source-separating identification in ensemble performance, a technique called "audio-source identification using an adaptive mixture template" has been proposed. According to the proposed, a multiagent architecture is configured to include an initiator for initiating processing, a promoter for promoting agent processing, an agent network used as a main unit for audio-source separation and identification, and a mediator for performing agent mediation.

Furthermore, a method for predicting musical instruments played in a performance has already been proposed. In the method, zero points are set on a frequency axis at identical pitches, and a comb-type filter is used that is capable of eliminating all frequency components corresponding to sampling frequencies. In this configuration, pitch-name identification, chord-separation, and spectral structures are used to predict musical instruments.

In the present embodiment, one of the known techniques is used in the audio-source separating section 2. With any one of the techniques, as a practical audio-source-separating signal processing, time-series data of a frequency spectrum of an input signal is once preserved in a memory, and components having high correlation coefficients are retrieved from the spectrum data preserved in the memory. Thereby audio-source separation can be implemented. The preprocess control section 6 specifies how to separate the audio source in the audio-source separating section 2. In this case, control-information input section 5 supplies control information regarding the audio-source separation to the preprocess control section 6.

FIG. 3 is a conceptual view showing an example input screen displayed in the control-information input section 5 of the present embodiment. In the control-information input section 5, devices such as the mouse 23 and the keyboard 24 are used to input desired control information through an input screen displayed on the display 25 of the personal computer 22*a*. In FIG. 3, specification is done such that an input music signal is separated into a vocal signal at part number "0" and the other signal at part number "1".

The control-information input section 5 inputs control information regarding the contents of signal processing for at least one of the audio sources that are separated by the physical-property converting section 3. In the example shown in FIG. 3, no signal processing is performed for the vocal signal. For the other signal, however, control information is inputted that is related to, for example, limitations for frequency bands, dynamic ranges, and coupling processing. The coupling processing refers to processing that synthesizes signals on R and L channels into a single-channel signal. The control information inputted in this case is supplied to the physical-property converting section 3 via the preprocess control section 6.

According to the aforementioned control information, while the physical-property converting section 3 does not perform any conversion for the vocal signal, the physical-property converting section 3 eliminates a part of an energy component of the other component (the other signal) than the vocal signal. The energy component is partly eliminated for the reasons that, in most cases, the perception of a human listener is not uniform for the vocal signal and the other signal, and the human listener concentrates the perception on vocal sound having high musical importance. In this way, a consideration is given to an auditory masking phenomenon of the vocal signal with respect to the other signal. In addition to the above, conversions for a physical property include reduction of the energy level, compression of the energy-level dynamic range, and conversion from a stereophonic signal to a monophonic signal for a band component having a frequency that is higher than an arbitrarily determined frequency of at least one of input signals.

As described above, while maintaining the quality of the vocal signal that has musically important semantics, the physical-property converting section 3 converts the physical property of only the signal component that does not have musical importance.

The plurality of audio-source signals subjected to the signal processing in the physical-property converting section 3 in units of the audio source are inputted to the signal-synthesizing section 4. The signal-synthesizing section 4 synthesizes the plurality of music signals into a signal of the original channel, and supplies the signal to the data-compressing section 8 as an output signal of the preprocessing section 7A.

A case can occur in which multiple-channel signals as the vocal signal and the other signal are outputted from the signal-synthesizing section 4. In this case, subsequent compression/decompression processing is performed in units of the multiple channels.

Subsequently, the data-compressing section 8 performs data-compression processing to reduce the data rate of the music signal. As described above, in the case in which signals of multiple channels are outputted, it is conceivable such that the bitrate in compression processing only for the vocal channel having high musical importance is increased, and a compression method such as CELP (code-excited liner prediction) method dedicated for sound is applied to the vocal component. In this case, it is conceivable that a different compression method, such as an MIDI method, is applied for the other musical-instrument channel. By using the methods, the data rate to be allocated to the vocal-signal component having high musical importance can be increased to be relatively high in comparison to that for compressed data represented by the other signal. The output data of the data-compressing section 8 is stored as compressed data into the data-storage section 10.

Upon requirement, the data-decompressing section 9 reads out compressed data stored in the data-compressing section 8, performs data-decompression processing, and outputs a music signal via the music-signal output section 11. In the present embodiment, although the data-compression processing and the data-decompression processing are equivalent to those of the conventional types, the preprocessing is applied at a stage preceding the data-compressing section. Consequently, the quality in auditory perceptibility of the vocal signal that is a musically important part can be improved to be relatively high in comparison to the case of the conventional method.

(Second Embodiment)

Figure 4:
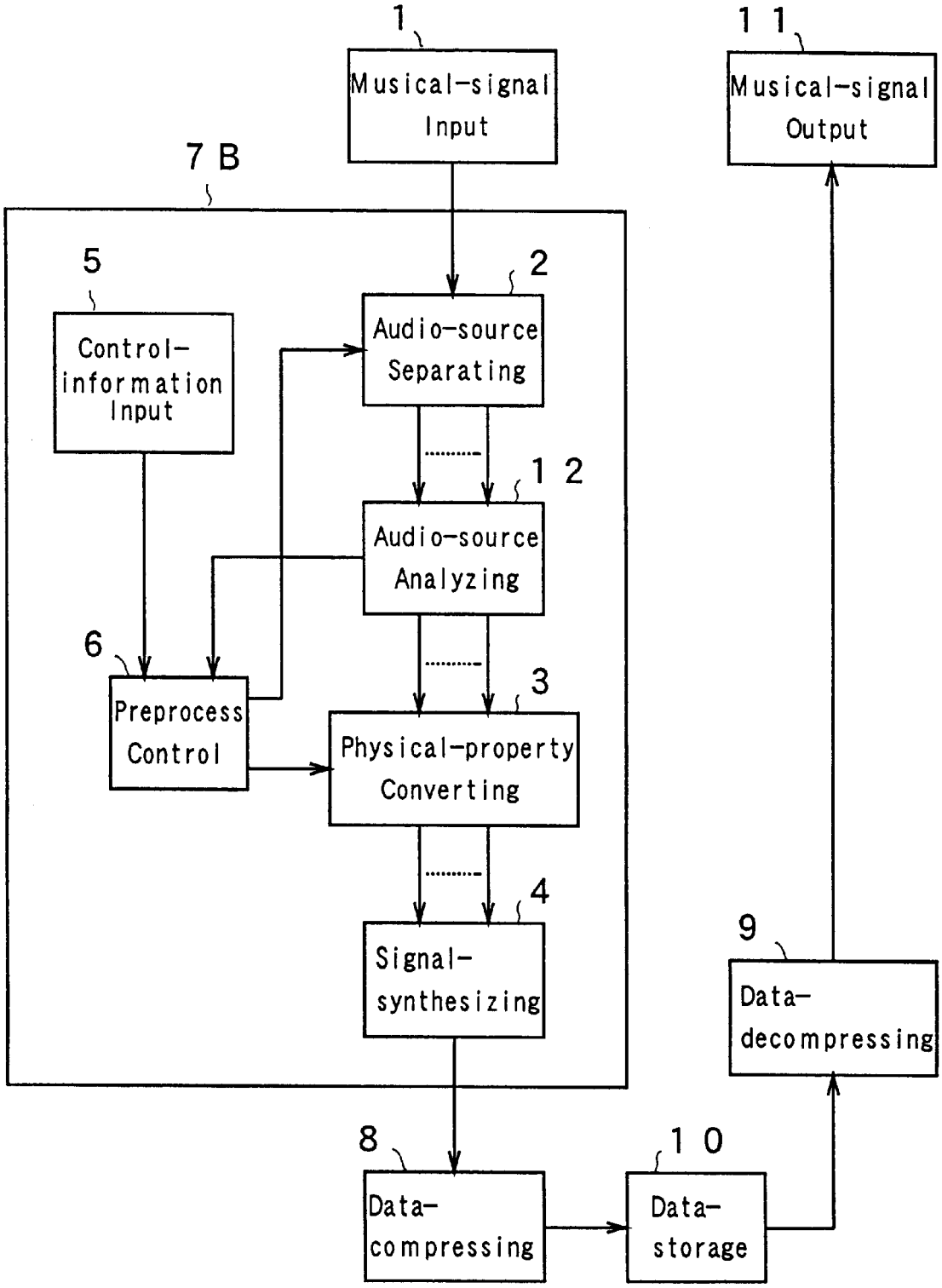
FIG. 4 is a configuration view showing a music-signal compressing/decompressing apparatus according to a second embodiment of the present invention.

Hereinbelow, a music-signal compressing/decompressing apparatus according to a second embodiment of the present invention will be described with reference to the accompanying drawings. FIG. 4 is a configuration view of a music-signal compressing/decompressing apparatus of the present embodiment. The same units as those in FIG. 1 are shown with the same reference numerals, and descriptions of thereof are omitted herefrom. The music-signal compressing/decompressing apparatus of the present embodiment is configured to include a music-signal input section 1, a preprocessing section 7B, a data-compressing section 8, a data-decompressing section 9, a data-storage section 10, and a music-signal output section 11. In the preprocessing section 7B, there are provided an audio-source separating section 2, an audio-source analyzing section 12, a physical-property converting section 3, a signal-synthesizing section 4, a control-information input section 5, and a preprocess control section 6.

The music-signal input section 1, the preprocessing section 7B, and the data-compressing section 8 have a function as a music-signal compression apparatus. In addition, the music-signal compression apparatus may be configured to additionally include the data-storage section 10.

The audio-source analyzing section 12 is provided to analyze a physical property of individual audio-source signals separated by the audio-source separating section 2. Thereby, the audio-source analyzing section 12 identifies a musically important part of an input music signal. In the present embodiment, the audio-source analyzing section 12 performs analysis for the energy level of each audio-source signal based on the general property that a musically important part has a high energy level. Time-wise variation data of the energy level of each music signal analyzed by the audio-source analyzing section 12 is outputted to the preprocess control section 6. The output signal is used as a trigger signal for controlling the physical-property converting section 3.

FIG. 5 is a conceptual view showing an example input screen displayed in the control-information input section 5 of the present embodiment. The audio-source separating section 2 of the present embodiment is assumed to separate the audio source for each musical-instrument. In addition to the items in the input screen in the first embodiment, FIG. 5 shows an item of the trigger level indicating control commencement for the physical-property converting section 3. In the arrangement shown in FIG. 5, for example, for a piano audio-source signal of part number "0", when the energy level of the piano audio-source signal analyzed by the audio-source analyzing section 12 is equal to or lower than (25 dB, the physical-property converting section 3 executes signal processing for the piano audio-source signal. Similarly, for a bass audio-source signal of part number "1", when the energy level of the bass audio-source signal analyzed by the audio-source analyzing section 12 is equal to or lower than 10 dB, the physical-property converting section 3 executes signal processing for the bass audio-source signal.

As described above, in the present embodiment, by additionally providing the audio-source analyzing section 12 in the preprocessing section 7B, a musically important part can be identified. Furthermore, also for the music signal in which the important part varies in time, the post-compression/decompression quality in the auditory perceptibility can be improved to be relatively high in comparison to the cases of the conventional methods.

(Third Embodiment)

Figure 6:
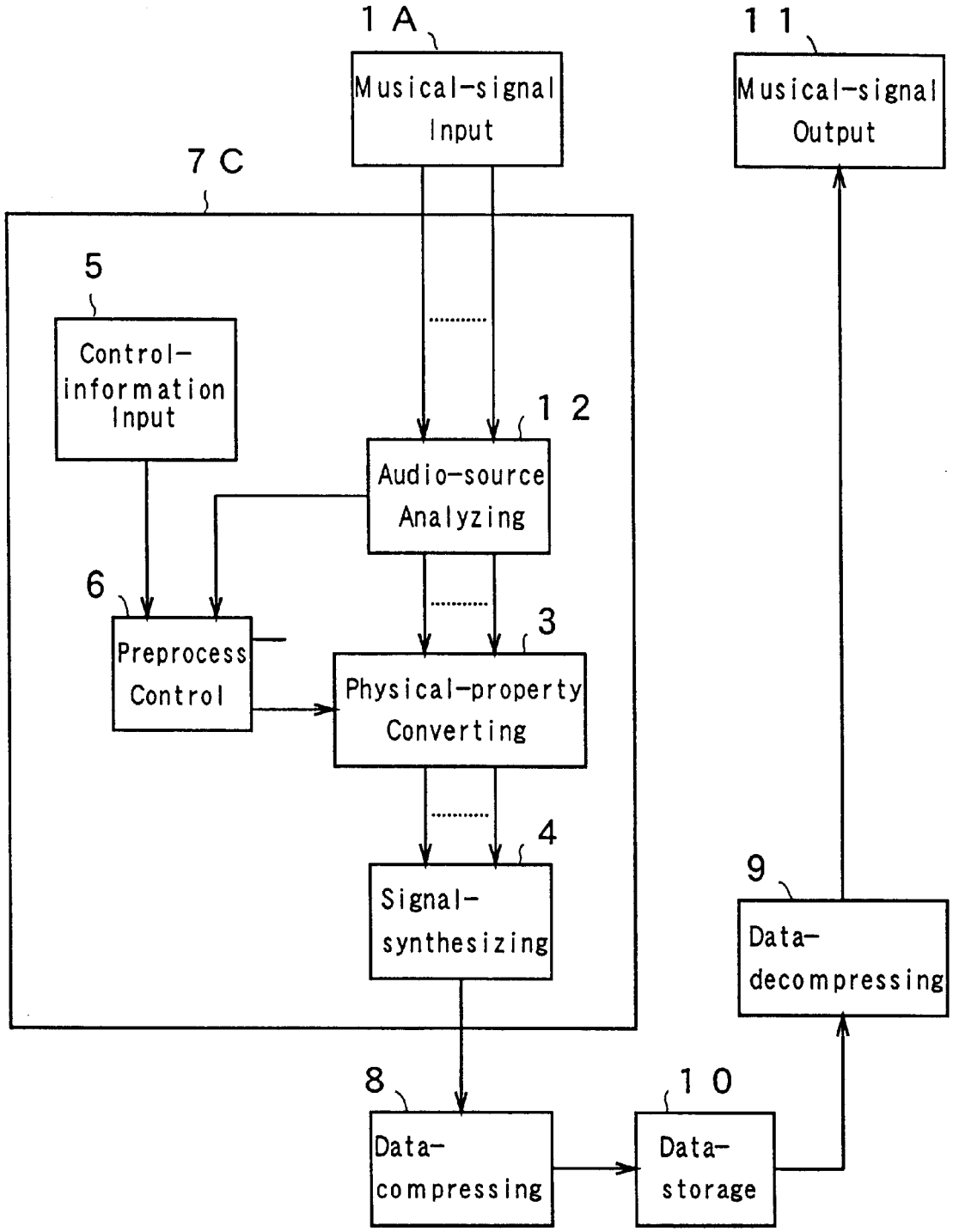
FIG. 6 is a configuration view showing a music-signal compressing/decompressing apparatus according to a third embodiment of the present invention.

Hereinbelow, a music-signal compressing/decompressing apparatus according to a third embodiment of the present invention will be described with reference to the accompanying drawings. FIG. 6 is a configuration view of a music-signal compressing/decompressing apparatus of the present embodiment. The same units as those in FIG. 1 are shown with the same reference numerals, and descriptions of thereof are omitted herefrom. The music-signal compressing/decompressing apparatus of the present embodiment is configured to include a music-signal input section 1A, a preprocessing section 7C, a data-compressing section 8, a data-decompressing section 9, a data-storage section 10, and a music-signal output section 11. In the preprocessing section 7C, there are provided an audio-source analyzing section 12, a physical-property converting section 3, a signal-synthesizing section 4, a control-information input section 5, and a preprocess control section 6. The music-signal input section 1A, the preprocessing section 7C, and the data-compressing section 8 have a function as a music-signal compression apparatus.

In the present embodiment, different from the music-signal input section 1 shown in FIG. 1, the music-signal input section 1A supplies per-audio-source signal to the audio-source analyzing section 12. For this reason, the audio-source separating section 2 in the embodiment 1 or 2 is omitted. Operations of the other sections in the processing blocks are the same as those in FIG. 2; therefore, descriptions thereof are omitted herefrom.

For example, in a case where new music is composed, or existing music is rearranged, per-part music signals are separately generated through microphones or electronic musical instruments in a studio, and are stored in a recording medium for recording multichannel signals. The multiple music signals are synthesized through mixing, and one piece of music is thereby completed. A division in charge of the creation of the musical contents can handle the individual per-audio-source signals. In this case, for example, a vocal music signal and accompaniment music signal can be supplied to the audio-source analyzing section 12 independently of each other. This configuration efficiently functions in a music-creating division. In addition, in the present embodiment, a music-signal compressing apparatus may be configured of the music-signal input section 1A, the preprocessing section 7C, and the data-compressing section 8.

(Fourth Embodiment)

Figure 7A:
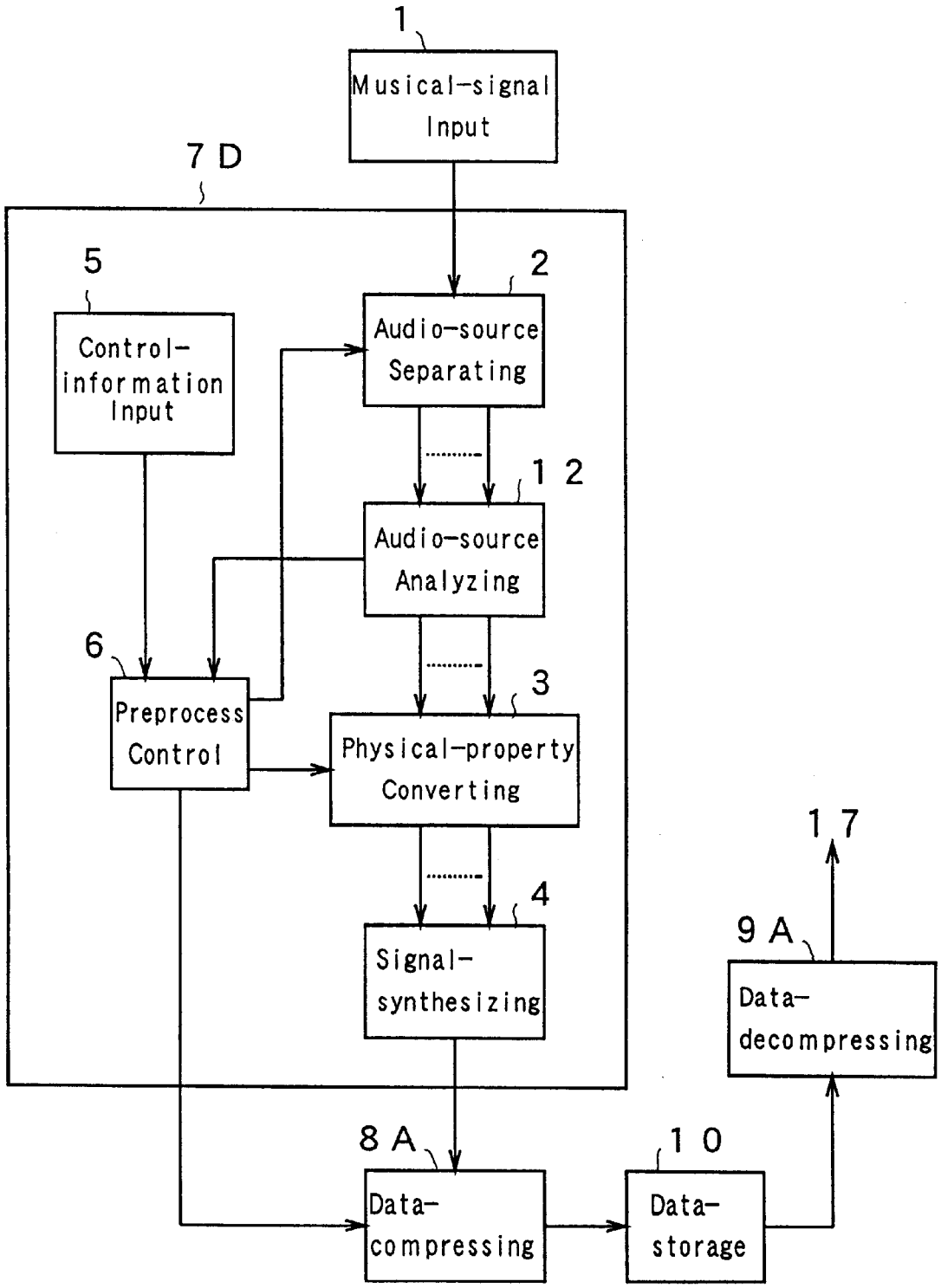
FIG. 7A is a configuration view showing a compressing part of a music-signal compressing/decompressing apparatus according to a fourth embodiment of the present invention.
Figure 7B:
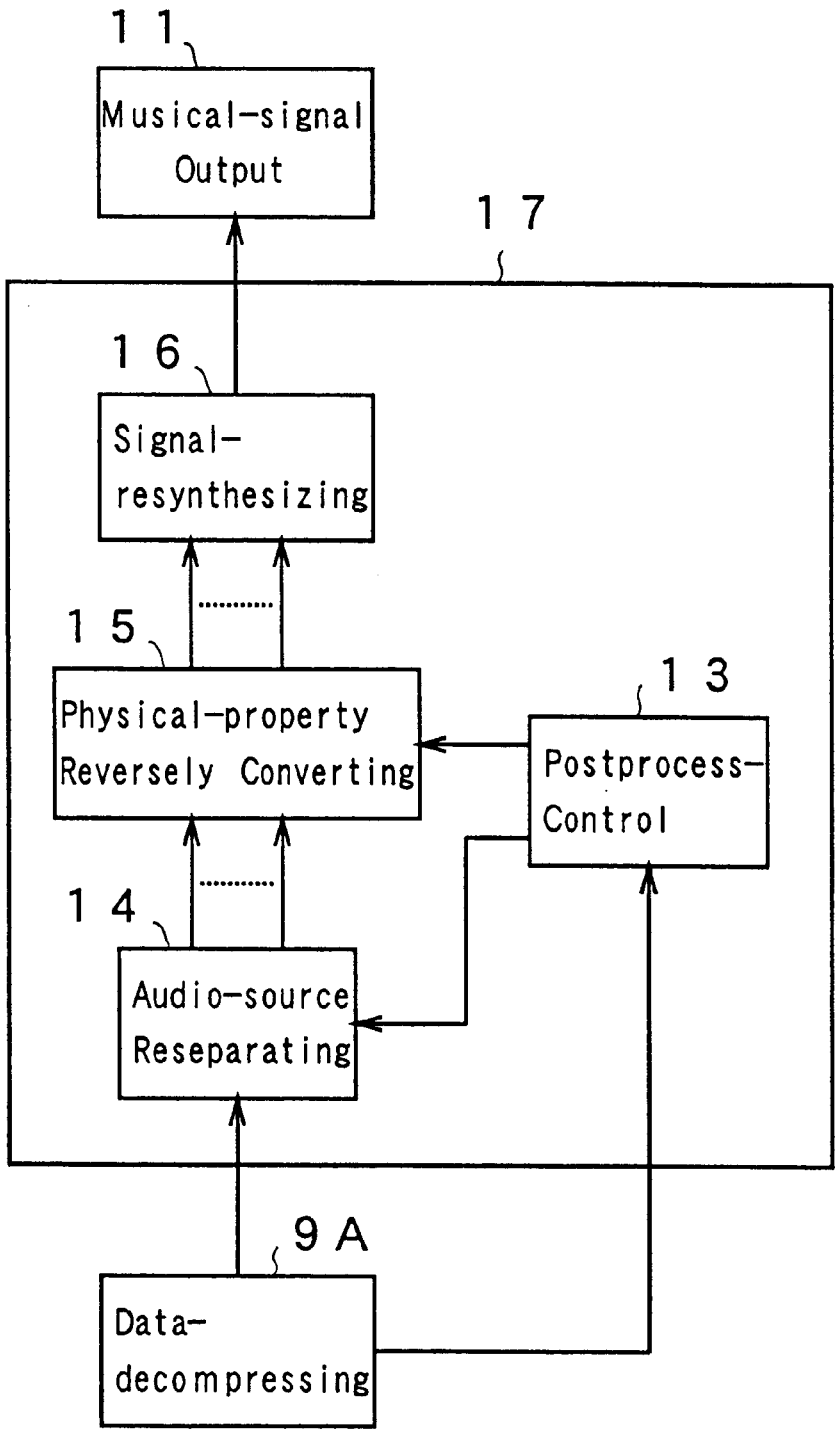
FIG. 7B is a configuration view showing a decompressing part of the music-signal compressing/decompressing apparatus according to a fourth embodiment.

Hereinbelow, a music-signal compressing/decompressing apparatus according to a fourth embodiment of the present invention will be described with reference to the accompanying drawings. FIGS. 7A and 7B are configuration views of a music-signal compressing/decompressing apparatus according to the present embodiment. The same units as those in FIG. 1 are shown with the same reference numerals, and descriptions of thereof are omitted herefrom. The music-signal compressing/decompressing apparatus of the present embodiment is configured to include a music-signal input section 1, a preprocessing section 7D, a data-compressing section 8A, a data-decompressing section 9A, a data-storage section 10, a postprocessing section 17, and a music-signal output section 11.

Similarly to the configuration shown in FIG. 2, in the preprocessing section 7D, there are provided an audio-source separating section 2, an audio-source analyzing section 12, a physical-property converting section 3, a signal-synthesizing section 4, a control-information input section 5, and a preprocess control section 6. The postprocessing section 17 includes a postprocess-control section 13, an audio-source reseparating section 14, a physical-property reversely converting section 15, and a signal-resynthesizing section 16. The postprocessing section 17 uses preprocessed information to perform compensation for the contents of signal processing performed by the preprocessing section 7D.

The data-compressing section 8A compresses an output signal of the preprocessing section 7D, and outputs preprocessed information. The data-storage section 10 stores data compressed by the data-compressing section 8A and the preprocessed information. The data-decompressing section 9A separates the compressed data and the preprocessed information that has been outputted from the preprocessing section 7D, and decompresses the data.

In the postprocessing section 17, as in the audio-source separating section 2, the audio-source reseparating section 14 reseparates an output signal of the data-decompressing section 9A into a plurality of signals separated for individually audio sources. The physical-property reversely converting section 15 performs compensatory processing for the conversion performed by the physical-property converting section 3 for individual signals separated by the audio-source reseparating section 14. The signal-resynthesizing section 16 synthesizes the plurality of output signals of the physical-property reversely converting section 15. The postprocess-control section 13 controls the audio-source reseparating section 14 and the physical-property reversely converting section 15 according to the preprocessed information that has is outputted from the data-decompressing section 9A.

Hereinbelow, a description will be made regarding operation of the music-signal compressing/decompressing apparatus according to the present embodiment configured as described above. In addition to the operation described in the second embodiment, the preprocess control section 6 outputs part or the entirety of control information intended for the audio-source separating section 2 and the physical-property converting section 3 to the data-compressing section 8A. This output operation is performed to enable the postprocessing section 17 to implement compensatory processing. In the present embodiment, among input items of control information shown in FIG. 5, the control information regarding, for example, the items of "part name", "trigger level", and "band" is outputted.

Subsequently, the data-compressing section 8A performs data-compression processing which is similar to that in the second embodiment. In addition, to an auxiliary area of the compressed data, the data-compressing section 8A writes a part of control information or the entirety of the data that has is outputted from the preprocess control section 6. The aforementioned data is thus written as preprocessed information that does not influence decompression of compressed data.

The data-decompressing section 9A reads out data stored in the data-storage section 10, and performs data-decompression processing which is similar to that in the second embodiment. In addition to data-decompression processing that is similar to that in the second embodiment, the data-decompressing section 9A reads out the preprocessed information of the compressed data, and outputs the read out data to the postprocess-control section 13. Subsequently, the postprocess-control section 13 inputs the preprocessed information, supplies the audio-source reseparating section 14 with information regarding the item of "part name", and also supplies the physical-property reversely converting section 15 with information regarding the items of "trigger level" and "band".

The audio-source reseparating section 14 performs separation processing that is similar to that performed at the time of data-compression processing in the second embodiment. As compensatory processing for conversion performed in the physical-property converting section 3 at the time of data-compression processing, the physical-property reversely converting section 15 boosts the energy level of a frequency component of which the band is limited. Subsequently, the signal-resynthesizing section 16 synthesizes the individual output signals of the physical-property reversely converting section 15 into an original-channel signal again. Then, the signal is supplied to the music-signal output section 11 as an output signal of the postprocessing section 17.

As described above, in the present embodiment, by adding the postprocessing section 17 to the configuration of the second embodiment, compensation can be implemented for reduction processing performed in the preprocessing section 7D for frequency components that are not musically important. Consequently, further improvement can be implemented for the quality of the music signal that is to be outputted from the output section 11.

(Fifth Embodiment)

Figure 8:
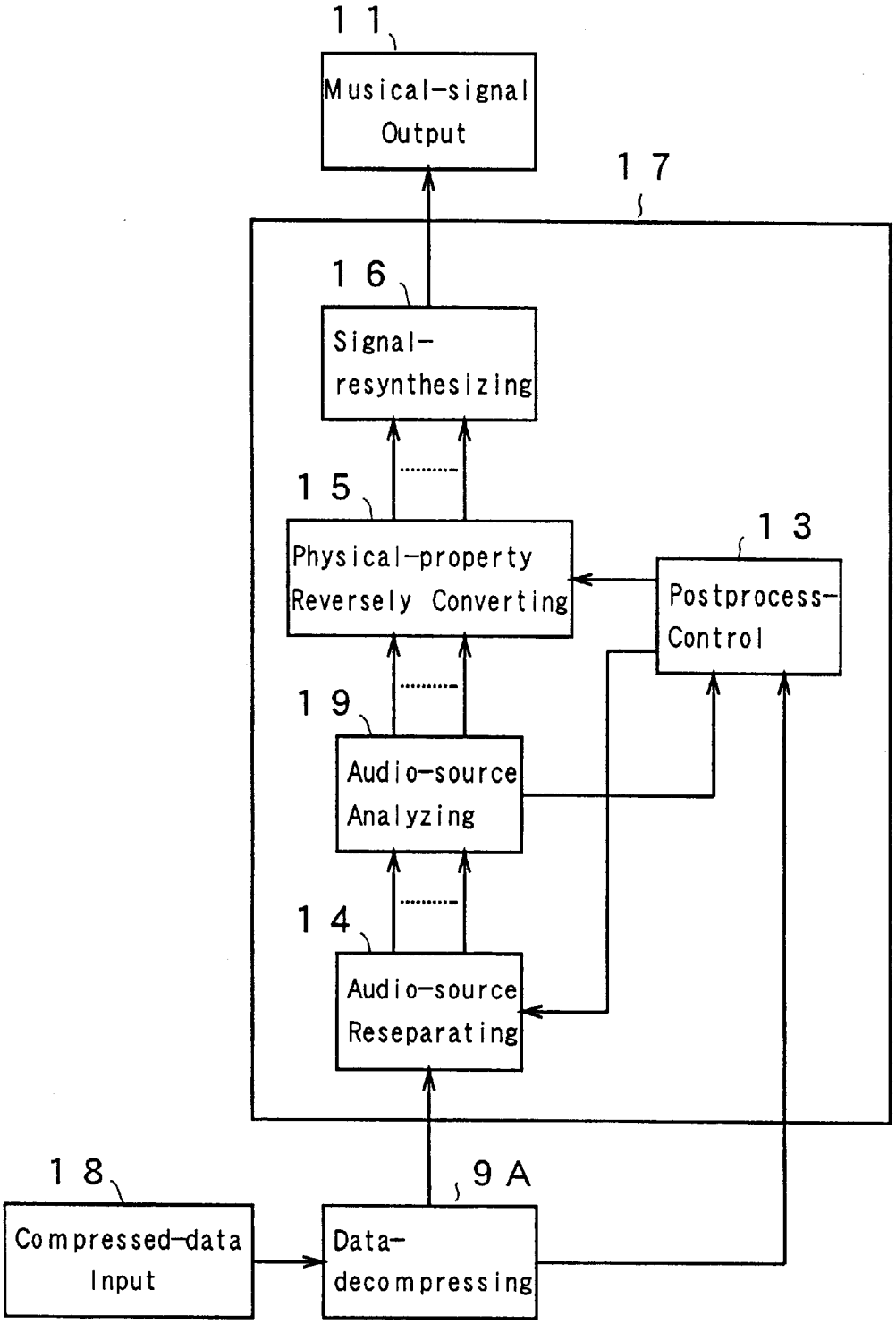
FIG. 8 is a configuration view showing a music-signal decompressing apparatus according to a fifth embodiment of the present invention.

As shown in FIG. 8, a music-signal decompressing apparatus of the fifth embodiment may be configured without using the preprocessing section 7D, the data-compressing section 8A, and the data-storage section 10 in the fourth embodiment. That is, using the data-decompressing section 9A, the postprocessing section 17, and the music-signal output section 11 may configure the music-signal decompressing apparatus.

In this configuration, compressed data is inputted from a compressed-data input section 18 and is outputted to the data-decompressing section 9A. Processes to be performed by the functional sections disposed subsequent to the data-decompressing section 9A are the same as those in the fourth embodiment.

In specific, the data-decompressing section 9A reads out compressed data from the compressed-data input section 18. Then, in addition to data-decompression processing which is similar to that in the second embodiment, the data-decompressing section 9A reads out preprocessed information of the compressed data, and outputs the data to the postprocess-control section 13. Subsequently, the postprocess-control section 13 inputs the preprocessed information, supplies an audio-source analyzing section 19 with information regarding the item of "part name", and supplies the physical-property reversely converting section with information regarding the item of "band".

The audio-source reseparating section 14 performs separation processing that is similar to that performed by the audio-source separating section 2 at the time of data-compression processing. When each audio-source signal is lower or equal to the trigger level, the audio-source analyzing section 19 outputs a control signal. The control signal controls so that the physical-property reversely converting section 15 boosts the energy level of a frequency component of which the band is limited. The aforementioned boosting is performed as compensatory processing of conversion performed in the physical-property converting section 3 when data is compressed. Subsequently, the signal-resynthesizing section 16 synthesizes the individual output signals of the physical-property reversely converting section 15 into an original-channel signal again. Then, the signal is supplied to the music-signal output section 11 as an output signal of the postprocessing section 17.

(Sixth Embodiment)

Figure 9:
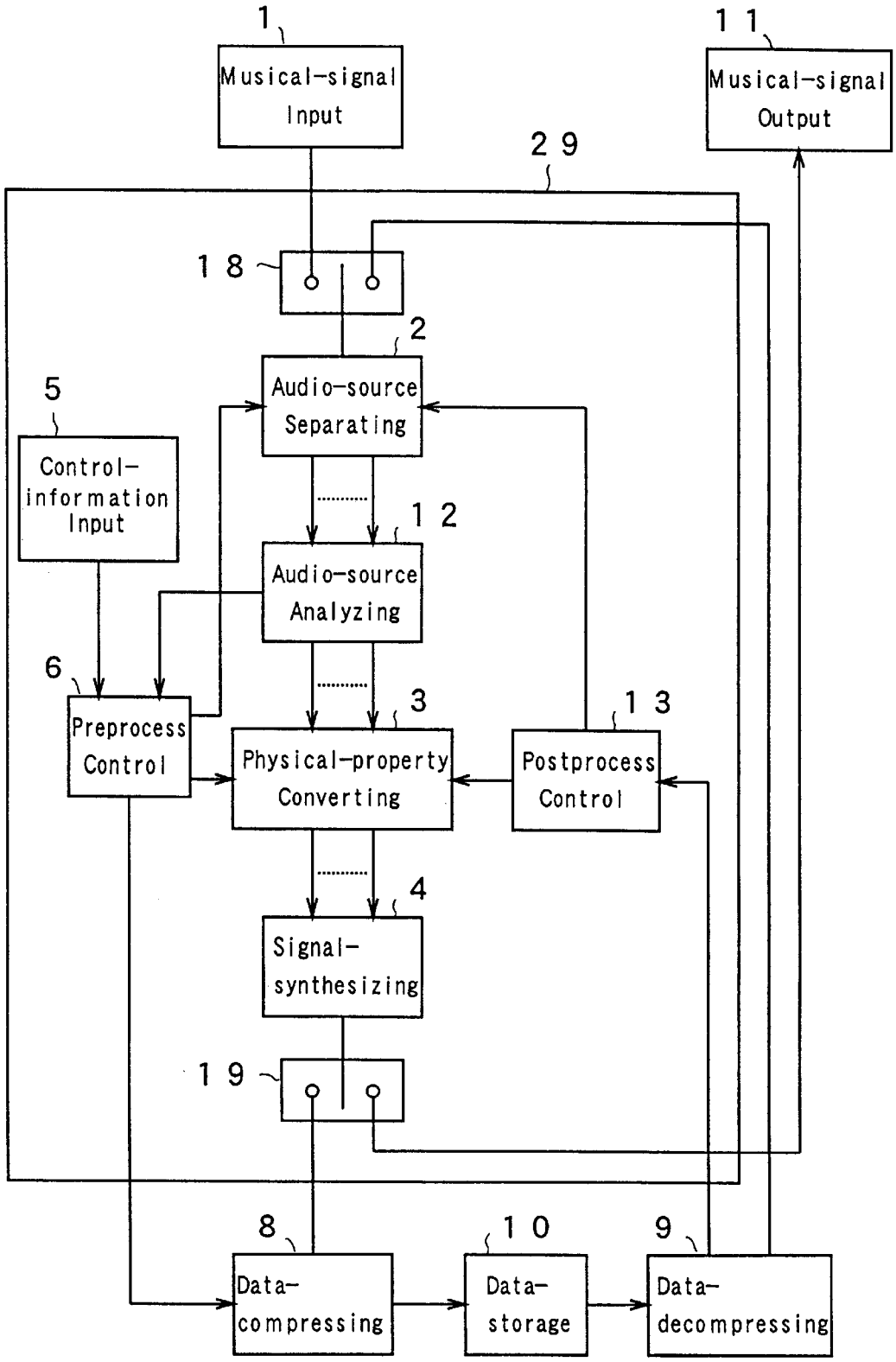
FIG. 9 is a configuration view showing a music-signal compressing/decompressing apparatus according to a sixth embodiment of the present invention.

Hereinbelow, a music-signal compressing/decompressing apparatus according to a sixth embodiment of the present invention will be described with reference to the accompanying drawings. FIG. 9 is a configuration view of a music-signal compressing/decompressing apparatus according to the present embodiment. The same units as those in FIG. 1 are shown with the same reference numerals, and descriptions of thereof are omitted herefrom. The music-signal compressing/decompressing apparatus of the present embodiment is configured to include a music-signal input section 1, a preprocessing/postprocessing section 29, a data-compressing section 8, a data-decompressing section 9, a data-storage section 10, and a music-signal output section 11.

The preprocessing/postprocessing section 29 includes a postprocess-control section 13, a first switch 18, and a second switch 19 in addition to an audio-source separating section 2, an audio-source analyzing section 12, a physical-property converting section 3, a signal-synthesizing section 4, a control-information input section 5, and a preprocess control section 6.

The fourth embodiment performs processing that is common to the processing blocks individually forming the preprocessing section 7D and the postprocessing section 17. In consideration about the common processing, the preprocessing/postprocessing section 29 is provided in the present embodiment to share the operations of the preprocessing section 7D and the postprocessing section 17. In this configuration, the first switch 18 and the second switch 19 can be operated to shift between a compression mode and a decompression mode to implement the shared operation.

The first switch 18 shifts to one of the compression mode and the decompression mode. Hereinbelow, signal processing performed in the preprocessing/postprocessing section 29 in the compression mode will be referred to as "first processing". Similarly, signal processing performed in the section 29 in the decompression mode will be referred to as "second processing". The second switch 19 operates in relation to the first switch 18 to supply an output of the section 29 to the data-compressing section 8 or the music-signal output section 11. The audio-source separating section 2 separates an output signal of the first switch 18 into a plurality of signals for individual audio sources. The audio-source analyzing section 12 performs analysis for a physical property of each of the signals separated by the audio-source separating section 2. The physical-property converting section 3 inputs an output signal of the audio-source analyzing section 12, and changes the physical property of each of the signals separated by the audio-source separating section 2. The signal-synthesizing section 4 synthesizes a plurality of output signals of the physical-property converting section 3.

The control-information input section 5 sets information regarding the contents of audio-source separation processing in the audio-source separating section 2 and information regarding the contents of physical-property converting processing in the physical-property converting section 3 in the compression mode. The control-information input section 5 then supplies the set information to the preprocess control section 6. The preprocess control section 6 controls the audio-source separating section 2 and the physical-property converting section 3 according to analysis-result data that has is outputted from the audio-source analyzing section 12 and control information that has is outputted from the control-information input section 5. Thereby, the preprocess control section 6 outputs the contents of the control performed for the audio-source separating section 2 and the physical-property converting section 3 to the data-compressing section 8 as preprocessed information. The postprocess-control section 13 controls the audio-source separating section 2 and the physical-property converting section 3 according to preprocessed information previously set in the decompression mode.

Hereinbelow, operation of the music-signal compressing/decompressing apparatus configured as above will be described. Descriptions regarding the same functions and processing as those of the fourth embodiment are omitted herefrom.

In the compression mode, the first switch 18 operates to cause operations to be performed similar to the preprocessing section 7D of the fourth embodiment. Namely, the music-signal input section 1 and the audio-source separating section 2 are coupled. The second switch 19 operates to couple the signal-synthesizing section 4 and the data-compressing section 8.

In the decompression mode, the first switch 18 operates to cause operations to be performed similar to the post processing section 17 of the fourth embodiment. Namely, the data-decompressing section 9 and the audio-source separating section 2 are coupled. The second switch 19 is operated to couple the signal-synthesizing section 4 and the music-signal output section 11.

As described above, in the preprocessing/postprocessing section 29, the first switch 18 and the second switch 19 for shifting between the compression mode and the decompression mode are provided to share the operation of the preprocessing section 7D and the postprocessing section 17. As such, reduction can be implemented in resources such as hardware and software for configuring the music-signal compressing/decompressing apparatus. Furthermore, reduction can be implemented in the costs of the music-signal compressing/decompressing apparatus.

In the above-described embodiments, although the preprocessing is performed by the preprocessing section at the step of music-signal compression, only the preprocessing section may be used as an independent preprocess control apparatus. The preprocess control apparatus can be realized by using, for example, semiconductor chips.

According to the above-described music-signal compressing apparatus of the present invention, with limited data-transfer rates or a storage capacity, musically important parts can be improved in the quality for auditory perceptibility, and can be outputted in that state. In particular, significant effects can be obtained in a case where compression processing needs to be performed at a high compression rate that can greatly degrade quality of compressed data.

Furthermore, according to the music-signal compressing/decompressing apparatus of the present invention, music maintained in the quality for auditory perceptibility can be listened through data transmitted at limited data-transfer rates or data stored in storage of a limited capacity.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

The text of Japanese priority application no. 2000-371074 filed on Dec. 6, 2000 is hereby incorporated by reference.

What is claimed is:

1. A music-signal compressing/decompressing apparatus comprising:

a music-signal input section which inputs a music signal;

a preprocessing section which performs preprocessing of said music-signal for an output signal of said music-signal input section at a stage preceding compression processing;

a data-compressing section which performs compression processing for an output signal of said preprocessing section;

a data-storage section which stores data compressed by said data-compressing section;

a data-decompressing section which performs decompression processing for compressed data read out from said data-storage section; and a music-signal output section which outputs an output data of said data-decompressing section as a music-signal, wherein said preprocessing section comprises:

an audio-source separating section which performs separation processing to separate the output signal of said music-signal input section into signals in units of the type of audio source;

a physical-property converting section which performs physical-property converting processing to change a physical property of at least one of the signals separated by said audio-source separating section;

a signal-synthesizing section which synthesizes a plurality of signals outputted from said physical-property converting section;

a control-information input section which inputs control information regarding the contents of the audio-source separation processing performed by said audio-source separating section and the contents of the physical-property converting processing performed by said physical-property converting section; and a preprocess control section which controls said audio-source separating section and said physical-property converting section in accordance with control information outputted from said control-information input section.

2. A music-signal compressing/decompressing apparatus according to claim 1, wherein:

said preprocessing section further comprises audio-source analyzing section which performs analysis of the physical property of each of the signals separated by said audio-source separating section;

said physical-property converting section receives an output signal of said audio-source analyzing section, and performs the physical-property converting processing on the basis of said output signal for changing the physical property of each of the signals separated by said audio-source separating section; and said preprocess control section performs control of said audio-source separating section and said physical-property converting section in accordance with analysis-result data outputted from said audio-source analyzing section and the control information outputted from said control-information input section.

3. A music-signal compressing/decompressing apparatus according to claim 1, wherein said audio-source separating section performs the separation processing to separate the input signal into a vocal signal and a signal that is different from said vocal signal.

4. A music-signal compressing/decompressing apparatus according to claim 1, wherein said physical-property converting section executes at least one of reduction in the energy level, elimination of a phase component, and conversion from a stereophonic signal to a monophonic signal for a band component having a frequency that is higher than an arbitrarily determined frequency of at least one of the input signals in units of the audio source.

5. A music-signal compressing/decompressing apparatus according to claim 1, wherein said physical-property converting section executes processing of compressing a dynamic range of the energy level for at least one of the input signals in units of the audio source.

6. A music-signal compressing/decompressing apparatus according to claim 2, wherein said audio-source analyzing section performs analysis of the energy level for each of the input signals in units of the audio source.

7. A music-signal compressing/decompressing apparatus according to claim 1, wherein:

said data-compressing section performs the compression processing for the output signal of said preprocessing section, and outputs preprocessed information;

said music-signal compressing/decompressing apparatus comprises a postprocessing section which performs postprocessing by using the preprocessed information for the output signal of said data-decompressing section;

said music-signal output section outputs an output data of said postprocessing section as a music-signal;

said preprocessing section includes an audio-source analyzing section which performs analysis of the physical property of each of the signals separated by said audio-source separating section;

said physical-property converting section inputs an output signal of said audio-source analyzing section, and performs the physical-property converting processing for changing said physical property of each of the signals separated by said audio-source separating section; and said preprocess control section which performs control of said audio-source separating section and said physical-property converting section in accordance with analysis-result data outputted from said audio-source analyzing section and the control information outputted from said control-information input section, and outputs the contents of the control for said audio-source separating section and said physical-property converting section to said data-compressing section, wherein said postprocessing section comprises:

an audio-source reseparating section which performs reseparation processing to reseparate the output signal of said data-decompressing section into a plurality of signals in units of the audio source by using said preprocessed information in a manner which is same as that of said audio-source separating section;

a physical-property reversely converting section which performs compensatory processing for conversion processing in said physical-property converting section by using said preprocessed information for each of the signals separated by said audio-source reseparating section;

a signal-resynthesizing section which synthesizes a plurality of signals of said physical-property reversely converting section; and a postprocessing control section which performs control of said audio-source reseparating section and said physical-property reversely converting section in accordance with said preprocessed information.

8. A music-signal compressing/decompressing apparatus according to claim 7, wherein said physical-property reversely converting section executes at least one of increase in the energy level, addition of a phase component, and conversion from a monophonic signal to a stereophonic signal for a band component having a frequency that is higher than an arbitrarily determined frequency of at least one of the input signals in units of the audio source.

9. A music-signal compressing/decompressing apparatus according to claim 7, wherein said physical-property reversely converting section executes processing of decompressing a dynamic range of the energy level for each of the input signals in units of the audio source.

10. A music-signal compressing/decompressing apparatus according to claim 7, wherein said audio-source analyzing section performs analysis of the energy level for each of the input signals in units of the audio source.

11. A music-signal compressing apparatus comprising:

a music-signal input section which inputs a music signal;

a preprocessing section which performs preprocessing of said music-signal for an output signal of said music-signal input section at a stage preceding compression processing; and a data-compressing section which performs compression processing for an output signal of said preprocessing section;

wherein said preprocessing section comprises:

an audio-source separating section which performs separation processing to separate the output signal of said music-signal input section into signals in units of the type of audio source;

a physical-property converting section which performs physical-property converting processing to change a physical property of at least one of the signals separated by said audio-source separating section;

a signal-synthesizing section which synthesizes a plurality of signals outputted from said physical-property converting section;

a control-information input section which inputs control information regarding the contents of the audio-source separation processing performed by said audio-source separating section and the contents of the physical-property converting processing performed by said physical-property converting section; and a preprocess control section which controls said audio-source separating section and said physical-property converting section in accordance with control information outputted from said control-information input section.

12. A music-signal compressing apparatus according to claim 11, wherein said audio-source separating section performs the separation processing to separate the input signal into a vocal signal and a signal that is different from said vocal signal.

13. A music-signal compressing apparatus according to claim 11, wherein said physical-property converting section executes at least one of reduction in the energy level, elimination of a phase component, and conversion from a stereophonic signal to a monophonic signal for a band component having a frequency that is higher than an arbitrarily determined frequency of at least one of the input signals in units of the audio source.

14. A music-signal compressing apparatus according to claim 11, wherein said physical-property converting section executes processing of compressing a dynamic range of the energy level for at least one of the input signals in units of the audio source.

15. A music-signal compressing apparatus according to claim 11, further comprising a storage section which stores data compressed by said data-compressing section.

16. A music-signal compressing apparatus according to claim 11, wherein:

said preprocessing section further comprises audio-source analyzing section which performs analysis of the physical property of each of the signals separated by said audio-source separating section;

said physical-property converting section inputs an output signal of said audio-source analyzing section, and performs the physical-property converting processing on the basis of the output signal to change the physical property of at least one of the signals separated by said audio-source separating section; and said preprocessing control section performs control of said audio-source separating section and said physical-property converting section in accordance with analysis-result data outputted from said audio-source analyzing section and the control information outputted from said control-information input section.

17. A music-signal compressing apparatus according to claim 16, wherein said audio-source analyzing section performs analysis of the energy level for each of the input signals in units of the audio source.

18. A music-signal decompressing apparatus which decompresses a music signal compressed by the music-signal compressing apparatus according to claim 11, comprising:

a data-decompressing section which performs decompressing process for input compressed data;

a postprocessing section which performs postprocessing by using said preprocessed information for an output signal of said data-decompressing section; and a music-signal output section which outputs output data of said data-decompressing section as a music signal, wherein said postprocessing section comprises:

an audio-source reseparating section which performs reseparation processing to reseparate the output signal of said data-decompressing section into a plurality of signals in units of the audio source by using said preprocessed information in a manner which is same as that of said audio-source separating section;

a physical-property reversely converting section which performs compensatory processing for conversion processing by said physical-property converting section for each of the signals separated by said audio-source-reseparating section by using said preprocessed information;

a signal-resynthesizing section which synthesizes a plurality of output signals of said physical-property reversely converting section; and a postprocessing control section which performs control of said audio-source reseparating section and said physical-property reversely converting section in accordance with said preprocessed information.

19. A music-signal decompressing apparatus according to claim 18, wherein said physical-property reversely converting section executes at least one of increase in the energy level, addition of a phase component, and conversion from a monophonic signal to a stereophonic signal for a band component having a frequency that is higher than an arbitrarily determined frequency of at least one of the input signals in units of the audio source.

20. A music-signal decompressing apparatus according to claim 18, wherein said physical-property reversely converting section executes processing of decompressing a dynamic range of the energy level for each of the input signals in units of the audio source.

21. A music-signal decompressing apparatus according to claim 18, wherein said audio-source analyzing section performs analysis of the energy level for each of the input signals in units of the audio source.

22. A music-signal compressing/decompressing apparatus comprising:

a music-signal input section which inputs each of a plurality of music signals separated in units of an audio source;

a preprocessing section which performs preprocessing of said music signal at a stage preceding compression processing for an output signal of said music-signal input section;

a data-compressing section which performs compression processing for an output signal of said preprocessing section;

a data-storage section which stores data compressed by said data-compressing section;

a data-decompressing section which performs decompression processing for compressed data read out of said data-storage section; and a music-signal output section which outputs an output data of said data-decompressing section as a music signal, wherein said preprocessing section comprises:

an audio-source analyzing section which analyzes a physical property of each of the signals outputted from said music-signal input section;

a physical-property converting section which inputs an output signal of said audio-source analyzing section and performs physical-property converting processing to change the physical property of each of the signals outputted from said music-signal input section;

a signal-synthesizing section which synthesizes a plurality of signals outputted from said physical-property converting section;

a control-information input section which inputs information regarding the contents of the plurality of audio-source signals outputted from said music-signal input section and the contents of the physical-property converting processing performed by said physical-property converting section; and a preprocessing control section which performs control of said physical-property converting section in accordance with analysis-result data outputted from said audio-source analyzing section and control information outputted from said control-information input section.

23. A music-signal compressing/decompressing apparatus according to claim 22, wherein said physical-property converting section executes at least one of reduction in the energy level, elimination of a phase component, and conversion from a stereophonic signal to a monophonic signal for a band component having a frequency that is higher than an arbitrarily determined frequency of at least one of the input signals in units of the audio source.

24. A music-signal compressing/decompressing apparatus according to claim 22, wherein said physical-property converting section executes processing of compressing a dynamic range of the energy level for at least one of the input signals in units of the audio source.

25. A music-signal compressing/decompressing apparatus according to claim 22, wherein said audio-source analyzing section performs analysis of the energy level for each of the input signals in units of the audio source.

26. A music-signal compressing apparatus comprising:

a music-signal input section which inputs each of a plurality of music signals separated in units of an audio source;

a preprocessing section which performs preprocessing of said music signal at a stage preceding compression processing for an output signal of said music-signal input section; and a data-compressing section which performs compression processing for an output signal of said preprocessing section;

wherein said preprocessing section comprises:

an audio-source analyzing section which analyzes a physical property of each of the signals outputted from said music-signal input section;

a physical-property converting section which inputs an output signal of said audio-source analyzing section and performs physical-property converting processing to change the physical property of each of the signals outputted from said music-signal input section;

a signal-synthesizing section which synthesizes a plurality of signals outputted from said physical-property converting section;

a control-information input section which inputs information regarding the contents of the plurality of audio-source signals outputted from said music-signal input section and the contents of the physical-property converting processing performed by said physical-property converting section; and a preprocessing control section which performs control of said physical-property converting section in accordance with analysis-result data outputted from said audio-source analyzing section and control information outputted from said control-information input section.

27. A music-signal compressing apparatus according to claim 26, wherein said physical-property converting section executes at least one of reduction in the energy level, elimination of a phase component, and conversion from a stereophonic signal to a monophonic signal for a band component having a frequency that is higher than an arbitrarily determined frequency of at least one of the input signals in units of the audio source.

28. A music-signal compressing apparatus according to claim 26, wherein said physical-property converting section executes processing of compressing a dynamic range of the energy level for at least one of the input signals in units of the audio source.

29. A music-signal compressing apparatus according to claim 26, wherein said audio-source analyzing section performs analysis of the energy level for each of the input signals in units of the audio source.

30. A music-signal compressing apparatus according to claim 26, further comprising a storage section which stores data compressed by said data-compressing section.

31. A music-signal compressing/decompressing apparatus comprising:

a music-signal input section which inputs a music signal;

a music-signal output section which outputs a music signal subjected to data-compression/decompression processing;

a preprocessing/postprocessing section which performs either of first processing or second processing when setting preprocessing in a compression mode which performs compression processing for an output signal of said music-signal input section as said first processing, and setting postprocessing in a decompression mode which performs decompression processing for outputting to said music-signal output section as said second processing;

a data-compressing section which performs compression processing for an output signal of said preprocessing/postprocessing section in said compression mode and which outputs preprocessed information;

a data-storage section which stores data and said preprocessed information compressed by said data-compressing section; and a data-decompressing section which performs decompression processing for the compressed data outputted from said data-storage section in said decompression mode, wherein said preprocessing/postprocessing section comprises:

a first switch which shifts to said first processing or said second processing;

a second switch which operates in relation to said first switch and gives an output of said preprocessing/postprocessing section to said data-compressing section or said music-signal output section;

an audio-source separating section which performs separation processing for an output signal of said first switch in units of the type of audio source;

an audio-source analyzing section which performs analysis of a physical property of each of the signals separated by said audio-source separating section;

a physical-property converting section which inputs an output signal of said audio-source analyzing section and which performs physical-property converting processing to change the physical property of each of the signals separated by said audio-source separating section;

a signal-synthesizing section which synthesizes a plurality of signals outputted from said physical-property converting section and which outputs to said second switch;

a control-information input section which inputs control information regarding the contents of the audio-source separation processing performed by said audio-source separating section and the contents of the physical-property converting processing performed by said physical-property converting section when said first processing is performed;

a preprocessing control section which performs control of said audio-source separating section and said physical-property converting section in accordance with analysis-result data outputted from said audio-source analyzing section and control information outputted from said control-information input section and which outputs the contents of the control of said audio-source separating section and said physical-property converting section to said data-compressing section as said preprocessed information; and a postprocessing control section which performs control of said audio-source separating section and said physical-property converting section in accordance with said preprocessed information when said second processing is performed.

32. A music-signal compressing/decompressing apparatus according to claim 31, wherein said audio-source separating section performs the separation processing to separate the input signal into a vocal signal and a signal that is different from said vocal signal.

33. A music-signal compressing/decompressing apparatus according to claim 31, wherein said physical-property converting section executes at least one of reduction in the energy level, elimination of a phase component, and conversion from a stereophonic signal to a monophonic signal for a band component having a frequency that is higher than an arbitrarily determined frequency of at least one of the input signals in units of the audio source when said first processing is performed, and executes at least one of increase in the energy level, addition of a phase component, and conversion from a monophonic signal to a stereophonic signal for a band component having a frequency that is higher than an arbitrarily determined frequency of at least one of the input signals in units of the audio source when said second processing is performed.

34. A music-signal compressing/decompressing apparatus according to claim 31, wherein said physical-property converting section executes processing of compressing a dynamic range of the energy level for at least one of the input signals in units of the audio source when said first processing is performed, and executes processing of decompressing a dynamic range of the energy level for each of the input signals in units of the audio source when said second processing is performed.

35. A music-signal compressing/decompressing apparatus according to claim 31, wherein said audio-source analyzing section performs analysis of the energy level for each of the input signals in units of the audio source.

36. A preprocessing control apparatus which performs preprocess control before an input music signal is compressed, comprising:

an audio-source separating section which performs separation processing to separate an input signal into signals in units of the type of audio source;

a physical-property converting section which performs physical-property converting processing to change a physical property of each of the signals separated by said audio-source separating section;

a signal-synthesizing section which synthesizes a plurality of signals outputted from said physical-property converting section;

a control-information input section which inputs control information regarding the contents of the audio-source separation processing performed by said audio-source separating section and the contents of the physical-property converting processing performed by said physical-property converting processing section; and a preprocessing control section which performs control of said audio-source separating section and said physical-property converting section in accordance with control information outputted from said control-information input section.

37. A preprocessing control apparatus according to claim 36, wherein:

said preprocessing control apparatus further comprises an audio-source analyzing section which performs analysis of the physical property of each of the signals separated by said audio-source separating section;

said physical-property converting section receives an output signal of said audio-source analyzing section, and performs the physical-property converting processing on the basis of said output signal for changing the physical property of each of the signals separated by said audio-source separating section; and said preprocess control section performs control of said audio-source separating section and said physical-property converting section in accordance with analysis-result data outputted from said audio-source analyzing section and the control information outputted from said control-information input section.

38. A preprocessing control apparatus according to claim 36, wherein said audio-source separating section performs the separation processing to separate the input signal into a vocal signal and a signal that is different from said vocal signal.

39. A preprocessing control apparatus according to claim 36, wherein said physical-property converting section executes at least one of reduction in the energy level, elimination of a phase component, and conversion from a stereophonic signal to a monophonic signal for a band component having a frequency that is higher than an arbitrarily determined frequency of at least one of the input signals in units of the audio source.

40. A preprocessing control apparatus according to claim 36, wherein said physical-property converting section executes processing of compressing a dynamic range of the energy level for at least one of the input signals in units of the audio source.

41. A preprocessing control apparatus according to claim 37, wherein said audio-source analyzing section performs analysis of the energy level for each of the input signals in units of the audio source.

* * * * *